United States Patent [19]

Vinciguerra

[11] 4,142,827

[45] Mar. 6, 1979

[54] SYSTEM FOR LOCKING THE BLADES IN POSITION ON THE STATOR CASE OF AN AXIAL COMPRESSOR

[75] Inventor: Constantino Vinciguerra, Florence, Italy

[73] Assignee: Nuovo Pignone S.p.A., Italy

[21] Appl. No.: 802,468

[22] Filed: Jun. 1, 1977

[30] Foreign Application Priority Data

Jun. 15, 1976 [IT] Italy ..... 24337 A/76

[51] Int. Cl.[2] ..... F01D 9/04

[52] U.S. Cl. ..... 415/189; 415/193; 415/218

[58] Field of Search ..... 416/221, 215, 219 R; 415/189, 190, 218, 217, 199.5, 191, 193, 137, 135, 141, 119

[56] References Cited

U.S. PATENT DOCUMENTS

| | | | |
|---|---|---|---|
| 930,908 | 8/1909 | Westinghouse | 415/135 |
| 2,786,648 | 3/1957 | Ledwith | 416/221 |
| 3,045,329 | 7/1962 | Carli et al. | 416/221 |
| 3,849,023 | 11/1974 | Klompas | 415/217 X |
| 3,997,280 | 12/1976 | Germain | 415/189 |
| 4,019,832 | 4/1977 | Salemme et al. | 416/218 R X |

FOREIGN PATENT DOCUMENTS

| | | | |
|---|---|---|---|
| 1476928 | 7/1969 | Fed. Rep. of Germany | 416/219 R |
| 124821 | 3/1928 | Switzerland | 416/215 |
| 620877 | 3/1949 | United Kingdom | 416/221 |

*Primary Examiner*—C. J. Husar
*Assistant Examiner*—Donald S. Holland
*Attorney, Agent, or Firm*—Morgan, Finnegan, Pine, Foley & Lee

[57] ABSTRACT

A locking system for locking in position the blades in the stator case of an axial compressor, wherein all of the blades are subjected exactly to the same locking load and can rapidly be assembled and disassembled when necessary. The system is especially suited for axial compressors which are required to operate in a dusty environment.

4 Claims, 4 Drawing Figures

SYSTEM FOR LOCKING THE BLADES IN POSITION ON THE STATOR CASE OF AN AXIAL COMPRESSOR

BACKGROUND OF THE INVENTION

This invention relates to a system for locking the blades in position on the stator case of an axial compressor.

Stator cases for axial compressors are formed either as a single piece or in two semi-cylindrical pieces which are then connected together after being provided with the respective blades. In both cases, the blades are mounted by adjacently inserting their bases or feet into suitable circumferential dovetail guides or housings provided on the inner surfaces of said stator cases. This insertion is done from the outside in the case of closed stator cases or laterally in the case of two-piece stator cases until said guides are completely filled. Systems already exist for locking the blades in position on the stator case of an axial compressor. In one of these known systems, specifically applied to closed stator cases, the blades inserted in the circumferential guides are locked in position by a single elastic band or other complicated locking means which, acting from the outside of the stator case, press simultaneously on the backs of the feet of all the blades to push said feet against the edges of the circumferential guides. In addition to increasing the radial dimension of the compressor, this system has the disadvantage that the blades are not all subjected to the same locking load because of inevitable constructional imperfections in the blade feet, so that the elastic band does not press uniformly on the backs of the feet.

In another known system, applied specifically to two-piece stator cases, the blade feet are constructed accurately with the same dimensions as the cross-section of the circumferential guide, so that they perfectly fit into the corresponding guide where they remain spontaneously locked in position. Such a system not only does not change the radial dimension of the compressor, but by reducing the gap between the guide and blade to practically zero ensures that all the blades are in an identical condition and operate under identical conditions. However, this system has two disadvantages. First, a complicated construction is required for accurate sizing of the guides and blade feet. Second, the impossibility of using a compressor with this blade locking system for compressing substances which in time are able to form dust deposits, such as uranium hexafluoride in radioactive uranium enrichment processes. In this respect, dust deposits create incrustations between the blade feet and the respective guides which lock them rigidly together, so making rapid dismantling of the blades impossible in the case of damage or for cleaning purposes.

SUMMARY OF THE INVENTION

The object of the present invention is to obviate said disadvantages by providing a new system for locking the blades in position in the circumferential dovetail guides of an axial compressor stator case constructed in two semi-cylindrical pieces, which is simple to construct, which does not change the radial dimension of the compressor, which uniformly locks all the blades by a predetermined constant load, and which ensures rapid blade disassembly even in a dusty environment.

According to one characteristic of the invention, this is attained by blade feet formed with a thickness less than the height of the guides and with a back curved transversely in the same direction as the guide roof so as to form therewith an interspace symmetrical about the central longitudinal region of said back, which progressively narrows until it reaches its minimum thickness at said central zone. The blade feet are pressed against said guides by curved springs which are forcibly inserted into said interspaces, said springs having approximately the same width as the backs of the blade feet, and a curvature opposite and approximately equal to that of said guide roof, and terminating at one end in a lip bent in the opposite direction to their curvature. In addition to obviating constructional complications and maintaining the radial dimension of the compressor unaltered, reliable and rapid assembly or disassembly of the blades is obtained by simply pressing with a suitable tool on the outer or inner surface of said lip of the curved springs, so as to insert or withdraw them from said interspaces respectively.

Furthermore, the configuration of the backs of the blade feet and the flat springs upon forcibly inserting said springs into said interspaces, causes a progressive deflection of the curved springs which reach their maximum degree of flattening when they are completely inserted, and this maximum flattening of the springs results in a pressure which, acting on said central region of the backs of the blade feet, pushes said blade feet against the respective guides so as to lock the blades in position with essentially a constant locking load.

In this respect, the considerable deflection undergone by the springs as they are inserted, causes the percentage variations in deflection due to the tolerances of the springs, the blade feet and the guides to be minimal and thus the variations in locking load also to be minimal.

To aid the progressive forced insertion of the curved springs into the interspaces and to render it more effective, the curvature of the backs of the blade feet is such that at the longitudinal ends of said feet, the interspace between the back and guide roof has a maximum thickness which is approximately 3/2 of the camber of the curvature of said curved springs. Accordingly, as the spring becomes progressively forced into the interspace, it is subjected by the back of the blade foot to a bending load which acts specifically on that part of the spring in contact with said back, and if said part is constructed as stated then this nearly coincides with the centre of the spring which is notably the most suitable region for effective and easy deflection of a spring.

According to a further characteristic of the invention, the lateral edges of the blade feet by which said blades rest on the respective circumferential dovetail guides are undercut in their central region.

In this manner, the central locking load transmitted by the spring to the back of the blade foot is distributed over those four end support regions of the lateral edges of the foot which effectively rest on the guide, resulting in improved support and in a more stable blade foot.

BRIEF DESCRIPTION OF THE DRAWINGS

The invention will be more evident with reference to the accompanying drawings which illustrate a preferred embodiment of the invention. It is to be understood that technical or constructional variations may be made thereto without leaving the scope of the present invention.

In said drawings.

DESCRIPTION OF THE PREFERRED EMBODIMENT

Figures 1, 2:
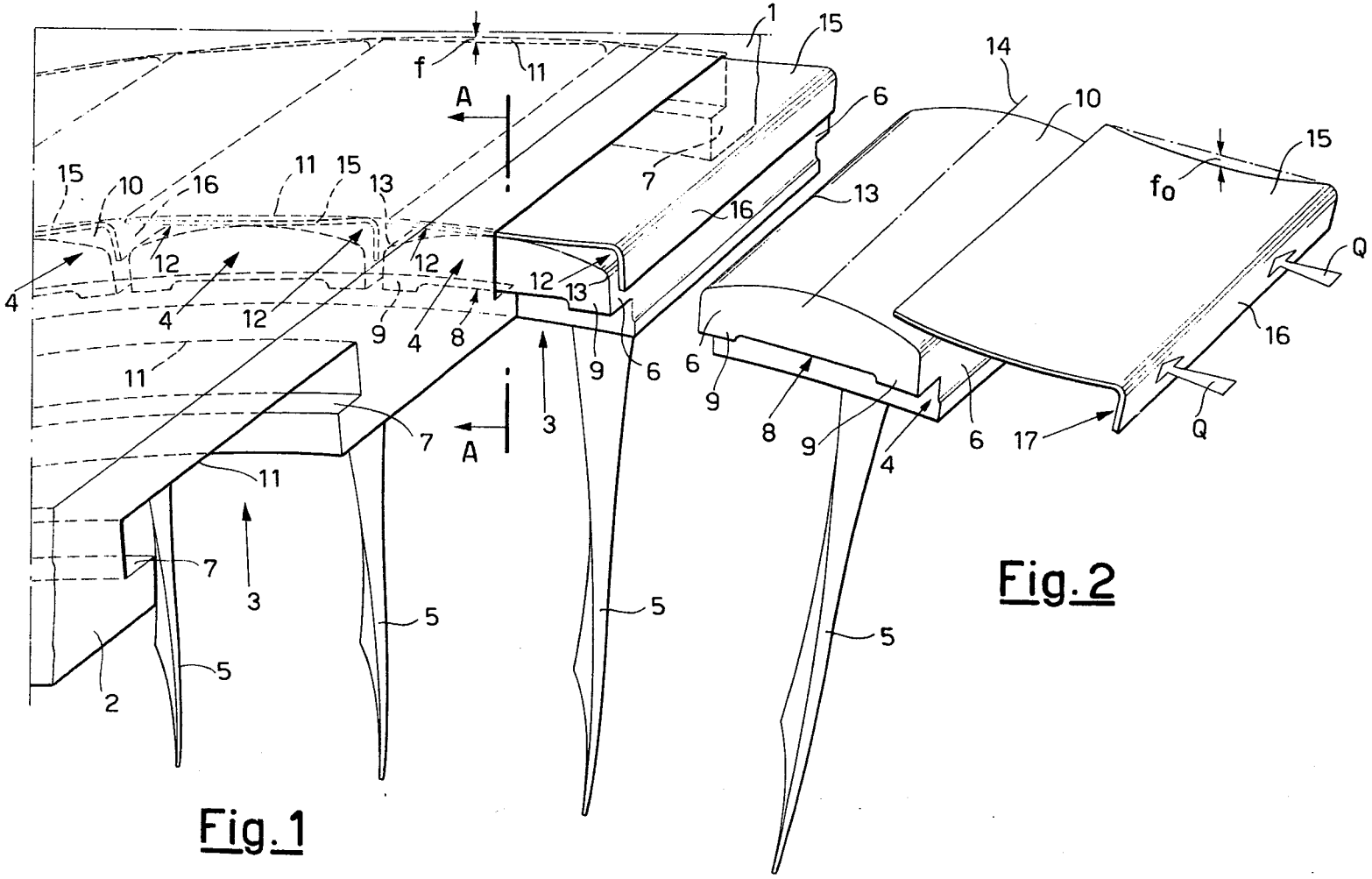
FIG. 1 is a perspective view of a portion of the stator case of an axial compressor with the blades mounted in accordance with the position locking system of the present invention.
FIG. 2 is a perspective view of the configuration of the elements constituting the blade position locking system according to the invention.
Figure 3:
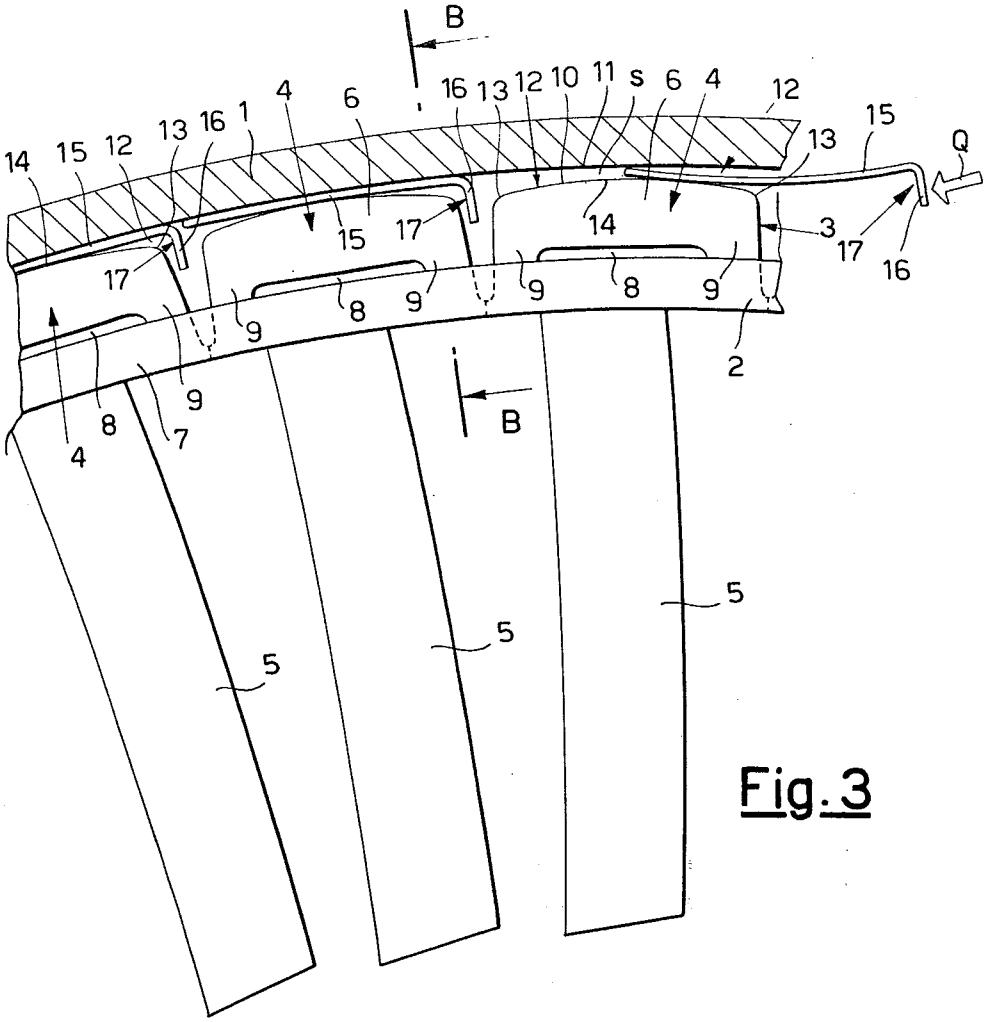
FIG. 3 is a lateral section on the line AA of FIG. 1.
Figure 4:
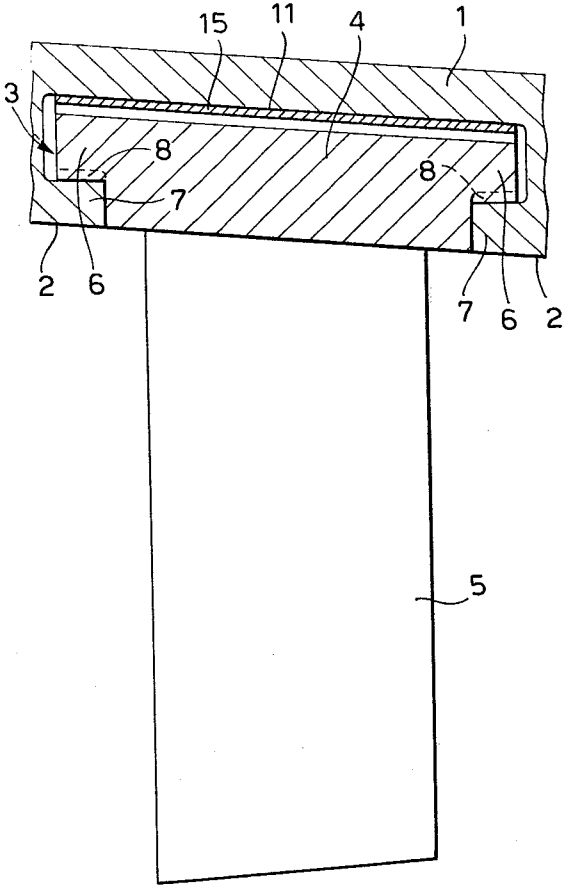
FIG. 4 is a front section on the line BB of FIG. 3.

With reference to the figures, the reference numeral 1 indicates a portion of one of the two semi-cylindrical pieces of the two-piece stator case of an axial compressor. On the inner surface 2 of the case are provided circumferential dovetail guides 3 into which the feet 4 of the blades 5 are adjacently inserted until the guides are completely filled. Each foot 4 comprises at its lateral ends projecting edges 6 which rest on the resting supports 7 of the guide 3. These lateral edges 6 are undercut in their central region by a groove 8 such that they rest on said supports 7 only by their four end regions 9. The back 10 of the blade feet is curved in its transverse direction in the same sense as the roof 11 of the circumferential guides 3 to form therewith an interspace 12 which progressively narrows from the longitudinal edges 13 of the back until it reaches its minimum thickness in the central longitudinal region 14 (see FIG. 2) of said back. The maximum thickness of the blade foot, i.e. the thickness of the foot in said central longitudinal region 14 of its back 10 is kept less than the height of the circumferential guide 3 so that the corresponding minimum thickness s (see FIG. 3) of the interspace 12 is slightly larger than the thickness of a spring 15. Said spring 15 is made approximately of the same width as the back 10 of the blade feet and with approximately the same curvature as the roof 11 of the circumferential guides 3 but in the opposite direction thereto, and comprises at its end a lip 16 bent in the opposite direction to its curvature. The curvature of the backs 10 of the blade feet is such that the maximum thickness of the interspace 12, i.e. its thickness at the longitudinal edges 13 of said backs, is approximately 3/2 of the camber $f_o$ (see FIG. 2) of the initial curvature of said curved springs 15.

The application of the system according to the invention is evident. Having fitted a blade in position by inserting its foot 4 into the relative circumferential guide 3, a spring 15 is inserted into the interspace 12 formed, by pressing with a force Q (see FIG. 2) on the outer surface of the bent lip 16 of the spring using a suitable tool. The spring is thus made to deflect from its initial value $f_o$ to a final value f (see FIG. 1), and thus biasing the blade radially inward by exerting a pressure along the longitudinal central region 4 of the back 10 of the blade foot, a pressure which thrusts the four end regions 9 of the lateral edges 6 of the blade foot radially inward against the corresponding resting supports 7 of the circumferential guide 3, so locking the blade in position. To withdraw the blades, the relative springs 15 are withdrawn by acting with said tool against the inner surface 17 of the spring lip 16.

What I claim is:

1. In an axial compressor having blades and a semi-cylindrical stator case with circumferential dovetailed guides on the interior thereof for receiving the feet of the blades until such guides are filled, means for locking the blades in position, comprising:

blades wherein each blade has a foot with lateral edges which rest on the guides, and a back which is curved transversely in the same direction as the curvature of the semi-cylindrical case so as to form therewith an interspace that is symmetrical about the central longitudinal region of said back and which progressively narrows until it reaches a minimum thickness at said cenral region, curved springs wherein each spring is located in the interspace between a foot and the case and has approximately the same width as the back of a foot, and a curvature opposite and approximately equal to that of said semi-cylindrical case for biasing the blade radially inward by exerting a pressure along the central region of the back of the foot, thereby thrusting said blade against the guide and locking the blade in position, and wherein each spring has a lip bent in the opposite direction to said curvature for assembly and disassembly of the blades.

2. Means for locking the blades in position as claimed in claim 1, wherein said minimum thickness of said interspaces formed between the back of the blade feet and said case is slightly larger than the thickness of said springs.

3. Means for locking the blades in position as claimed in claim 2, wherein the curvature of the back of the blade feet is such that at the longitudinal ends of said blade feet, said interspace between the back of the blade foot and said guide roof has a maximum thickness of approximately 3/2 of the camber of the curvature of said curved springs.

4. Means for locking the blades in position as claimed in claim 1, wherein said lateral edges by which the blade feet rest on the respective circumferential dovetail guides are undercut in their central region so that said feet have four end regions which rest on said guides and which are pressed thereagainst by one of said springs.

* * * * *

UNITED STATES PATENT AND TRADEMARK OFFICE

CERTIFICATE OF CORRECTION

PATENT NO. : 4,142,827
DATED : March 6, 1979
INVENTOR(S) : Costantino Vinciguerra It is certified that error appears in the above-identified patent and that said Letters Patent are hereby corrected as shown below:

First Page, Item [75], Correct first line to read

--Costantino Vinciguerra, Florence,--.

Col. 2, line 2, After "by" insert a comma --,--.

Signed and Sealed this

*Tenth* Day of *July 1979*

[SEAL]

*Attest:*

*Attesting Officer*

LUTRELLE F. PARKER
*Acting Commissioner of Patents and Trademarks*